United States Patent [19]

Lowrey

[11] Patent Number: 4,570,994

[45] Date of Patent: Feb. 18, 1986

[54] FOLDABLE CHAIR

[76] Inventor: Charles Lowrey, 770 Park Ave. (7D), New York, N.Y. 10021

[21] Appl. No.: 450,741

[22] Filed: Dec. 17, 1982

[51] Int. Cl.[4] ..... A47C 4/04; A47C 7/54; A47B 5/04

[52] U.S. Cl. ..... 297/19; 297/326; 297/328; 297/416; 108/149

[58] Field of Search ..... 297/325, 326, 327, 328, 297/281, 282, 27, 28, 416, 16, 19; 108/149, 134

[56] References Cited

U.S. PATENT DOCUMENTS

| | | | |
|---|---|---|---|
| 2,503,602 | 4/1950 | Titley | 108/134 |
| 2,633,897 | 4/1953 | Moore | 297/326 |
| 2,679,893 | 6/1954 | Bennett | 297/282 |
| 2,718,916 | 9/1955 | Borochoff | 297/326 |
| 2,865,431 | 12/1958 | Ruaud et al. | 297/27 |
| 3,227,110 | 1/1966 | Hamilton | 108/134 |
| 3,465,893 | 9/1969 | Kinney | 108/149 |
| 4,120,530 | 10/1978 | Imbro | 297/416 |

FOREIGN PATENT DOCUMENTS

| | | | |
|---|---|---|---|
| 701339 | 12/1940 | Fed. Rep. of Germany | 297/27 |
| 603980 | 6/1948 | United Kingdom | 297/327 |
| 952317 | 3/1964 | United Kingdom | 297/326 |

*Primary Examiner*—William E. Lyddane
*Assistant Examiner*—Mark W. Binder
*Attorney, Agent, or Firm*—Frishauf, Holtz, Goodman & Woodward

[57] ABSTRACT

A foldable chair has a base with upstanding portions extending upwardly from opposite sides of a forward portion thereof, and a seat member having its forward portion connected pivotally to these upstanding portions. Tension elements are connected to the upper end portions of the upstanding portions and rearward portions of the seat member for holding the seat member in an operative position. The length of the tension elements may be adjusted to vary the position of the seat member, and removable armrests may also be provided.

5 Claims, 8 Drawing Figures

FOLDABLE CHAIR

The present invention relates to a foldable chair having minimal components enabling the chair to be folded rather easily while maintaining an attractive appearance even when folded.

Chairs which may be folded into a compact condition for storage or transportation are, of course, well known. Such chairs typically have rather complicated folding mechanisms enabling the chair to be unfolded and held securely in position for use. Such folding mechansims are often difficult to use, and may often be rather unsightly. Such folding mechanisms may thus detract from the overall appearance of the chair, particularly when the chair is folded. Such chairs, therefore, cannot often be considered a piece of quality furniture and must often be stored out of view.

It is, therefore, an object of the present invention to provide an attractive chair which may be folded rather easily into a compact condition, and when folded, will still have an attractive appearance. In this way, the chair may still be considered a piece of high quality furniture even when folded.

A foldable chair according to the present invention comprises a base with upstanding portions extending upwardly from opposite sides of a forward portion of this base. A seat member has a forward end portion adapted to be connected pivotally between the upstanding portions of the base. The chair further has means including respective tension elements adapted to be connected between an upper end of each upstanding portion and respective rear portions of the seat member for holding the seat member in an operative position relative the base. The tension elements may each be flexible whereby the seat member may be pivoted forwardly into a position where the seat member becomes nestled within the base.

The seat member preferably has a back-rest portion extending upwardly from the rear thereof, and the base is comprised essentially by the upstanding portions noted above, runner portions extending rearwardly from the lower ends of these upstanding portions and a cross-piece portion extending between the rearward portions of the runner portions. In this way, the backrest portion can be nestled between the runner portions when the seat is in a folded condition.

Means may also be provided for releasing the tension elements from their connection between the upper ends of the upstanding portions and the seat member. In this way, the tension elements may be rigid and the releasing means enables the seat member to be pivoted either forwardly or rearwardly into a position nestled between the runner portions. The releasing means may include at least one nub portion formed on an end portion of each respective tension element. These nubs are adapted to fit within a respective slot formed in either of the assoicated upper ends of the upstanding portions of the base, or the assoicated rear portions of the seat member. The slot may have a portion having a width wider than the width of the associated nub and this slot may narrow to a portion narrower than the width of the nub whereby a nub can be inserted in the slot and held behind the narrower portions thereof.

Each of the tension elements may have a plurality of these nubs formed on their end portions. In this way, the length of the tension elements extending between the upper ends of the upstanding portions of the base and the associated rear portions of the seat member can be varied to adjust the operative position of the seat member to the base. Also, the upper ends of the upstanding portions of the base may be hollow so that removable armrests may be provided which have portions removably insertable into the hollow of these upper end portions.

A chair according to the present invention can thus be made of minimal components of high quality and appearance, and will provide an attractive appearance even when folded.

These and other objects, features and advantages of the present invention will become more apparent from the following detailed description of preferred embodiments thereof, taken in conjuction with the accompanying drawing figures, in which.

Figure 1:
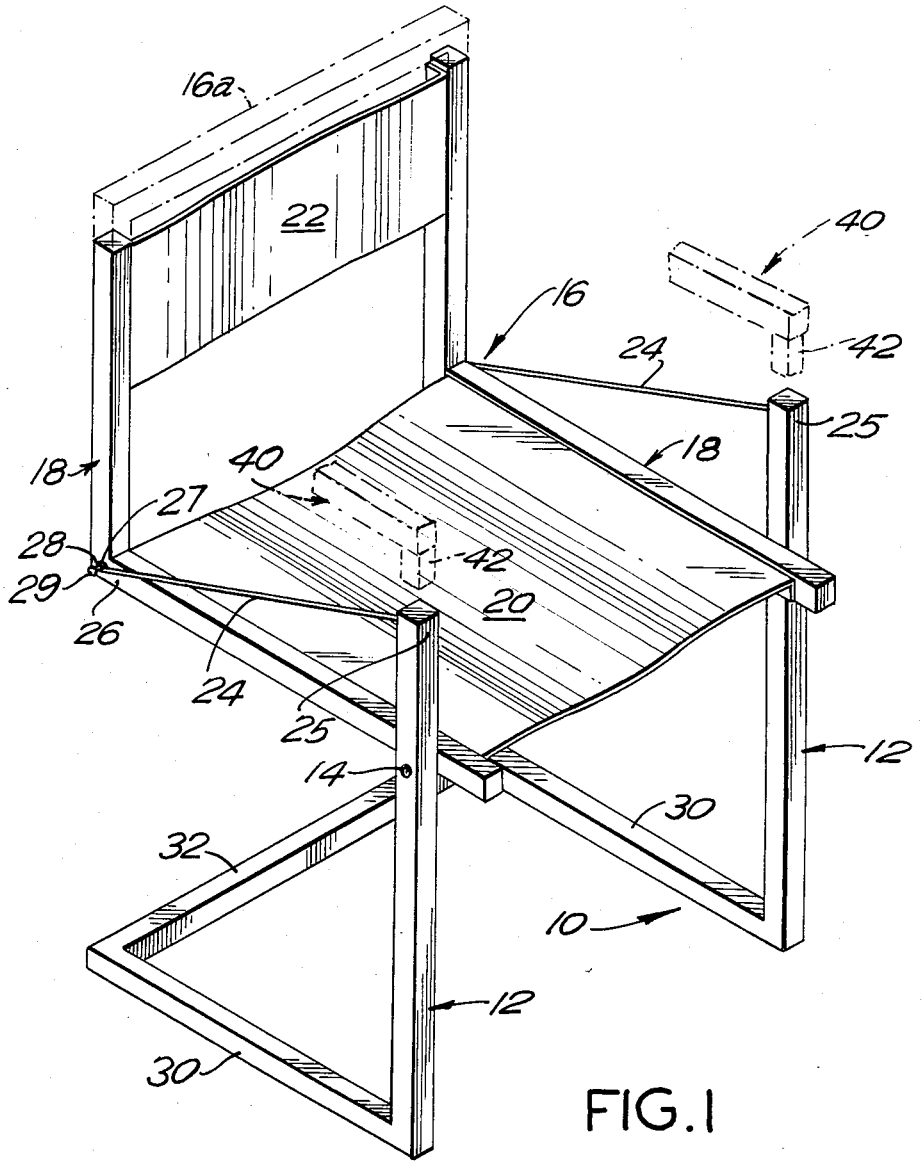
FIG. 1 is a perspective view of one embodiment of a chair according to the present invention.
Figure 7:
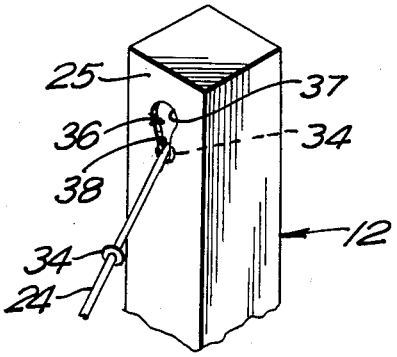
Figure 8:
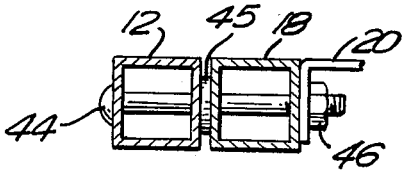
Figure 2:
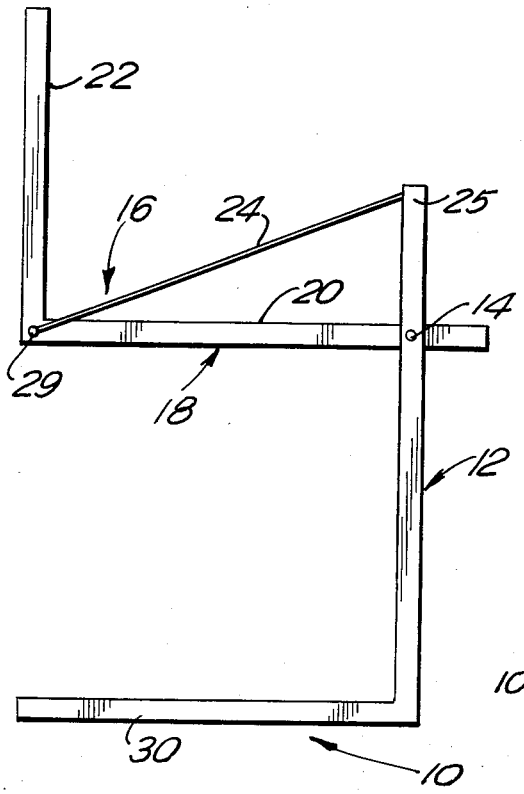
FIG. 2 is a side elevation of the chair of FIG. 1.
Figure 3:
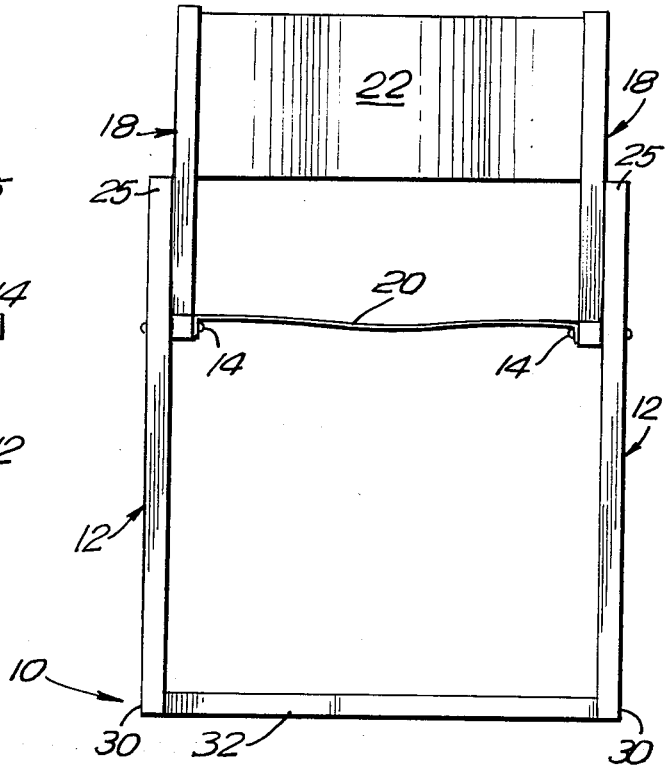
FIG. 3 is a rear elevation of the chair of FIG. 1.
Figure 4:
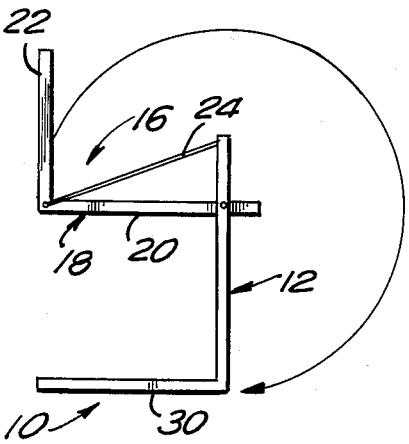
Figure 5:
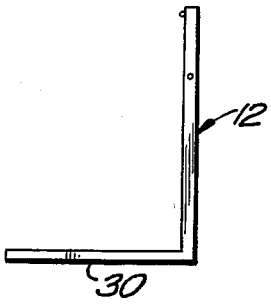
Figure 6:
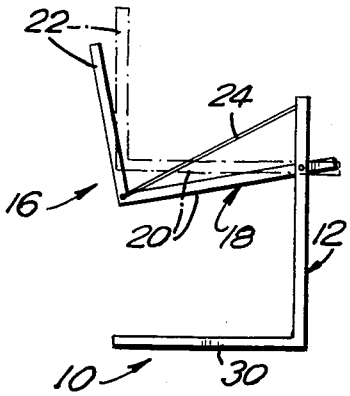

FIG. 4 a side elevation of the chair of FIG. 1 illustrating how it may be pivoted forwardly into a compact condition;

FIG. 5 is a side elevation of the chair of FIG. 1 folded into its compact position;

FIG. 6 is a side elevation of the chair of FIG. 1 illustrating how the operative position of the seat member may be adjusted relative the base member;

FIG. 7 illustrates one manner of attaching the tension elements to a chair according to the present invention; and FIG. 8 illustrates one form of a pivotal connection of the chair.

As illustrated in the accompanying drawings, a chair according to the present invention includes a base 10 having portions 12 upstanding from opposite sides of a forward portion of the base. These upstanding portions 12 are generally parallel and are connected pivotally by suitable connections 14 to a forward portion of a seat member 16. As illustrated in FIG. 1, the seat member may include two side portions 18 each having a generally L-shaped configuration and formed of a tubular material such as stainless steel or the like. The side portions preferably have an attractive and high quality finish of a type typical of high quality metal furniture. A seating element 20 and the backrest element 22 are connected between the side portions 18 and are formed of broad pieces of sheet metal. The seating element 20 and the backrest element 22 have an attractive finish and are secured to the side portions 18 by rivets or other suitable fasteners. The seating element 20 and the backrest 22 may be generally planar, as shown, or they may be formed by broad pieces of sheet metal which are contoured to fit the contours of the human body. The seating element 20 and the backrest element 22, may alternatively, be formed by flexible material such as fabric or leather having loops slid over the spaced side portions 18, as would be well understood by those skilled in the art. Preferably a top portion 16*a* shown in phantom lines is provided when the backrest 22 is formed of flexible material to provide improved structural rigidity and reinforcement.

In order to retain the seat member in an operative position relative the base 10, two tension elements 24 are connected between the upper ends 25 of respective upstanding portions 12 and rear portions 26 of the seat member. As illustrated in FIG. 1, the tension elements may have loops 27 formed at their one ends which are adapted to fit over projections 28 extending laterally from the rear portion of the seat member. These loops 27 of the tension elements may, therefore, be removed from the rear portion of the seat member by being slid laterally from the projections 28. The projections 28 may have enlarged head portions 29 in order to prevent the tension elements from sliding inadvertently off the projections. Alternatively, the tension elements may be formed with rigid hooked end portions adapted to be held within openings in the rear portions 26 of the seat member.

The tension elements may be formed of a flexible material, and in this way, the tension elements need not be removed from either the seat member 16 or the upstanding portions 12 for folding the chair. As illustrated in FIG. 4, for example, the seat member may be pivoted forwardly so that the backrest portion 22 will fit within the open front end of the base 10 so that it can be slid rearwardly into the compact condition illustrated in FIG. 5. Conversely, the tension elements could be removed from the rear portions of the seat member 16 or the upstanding portions 12, and thereby allow the seat member to be pivoted either forwardly or rearwardly into the position shown in FIG. 5. As illustrated in FIG. 5, the chair in its compact condition forms a rather attractive silouette which is not marred by any cumbersome mechanisms for folding the chair. The chair, therefore, is formed of only a minimal number of components which can be made of high quality, attractive materials enabling the chair to retain its nature as a high quality piece of furniture when folded.

The base 10 may take any of several forms, but preferably the base has runner portions 30 extending rearwardly from the lower ends of the upstanding portions 12, and a cross-piece portion 32 which extends between the rearward portions of the runner portions 30. In this way, the forward portion of the base 10 is open to enable the seat member 16 to pivot easily into the base member so as to form the silouette illustrated in FIG. 5.

The tension elements may be connected with the upper ends 25 of the upstanding portions 12 and the rear portions of the seat member 16 by any of several techniques, and in one form of the present invention, the tension elements are constructed so that their length extending between the upper ends 25 of the upstanding portions 12 and the rear portions of the seat member 16 can be varied and, in this way, the operative position of a seat member relative the base 10 can be varied. As shown in FIG. 7, this construction may be obtained by providing a nub 34 on an end portion of the tension element and a slot 36 formed in either or both of the upper end 25 of the upstanding member 12 or the rearward portion 26 of the seat member 16. The slot 36 has a portion 37 wider than the nub portions 34 and a narrower portion 38 which is less than the width of the nub portions 34. In this way, the nub portions 34 may be fitted within the wider portions 37 and slid behind the narrower portions 38 to secure their position. As will be well understood, the tension elements are thus easily removable and, by providing the plurality of these nubs along the ends of the tension element, the length of the tension elements between the upper end 25 of the upstanding portions 12 and the rear portions of the seat member can be varied whereby the angle of the seat member relative the base 10 can be readily adjusted, as illustrated in FIG. 6. Further, armrest portions 40 may be provided. As illustrated in FIG. 1, these armrest portions 40 may include portions 42 which may be inserted down within a hollow of the upper ends of the upstanding portions 12 so as to be removable therefrom rather easily. The armrest portions may, alternatively, be fixed to or integral with the upstanding portions 12.

Further, the seat member may be connected to the base by pivotal connections which may be easily taken apart. As shown in FIG. 8, the seat member may be joined to the base by a bolt 44 held by nut 46. In this way, the seat member may be separated rather easily from the base for transportation. Additionally, suitable washers 45 may be interposed between the upstanding portions 12 and the side portions 18 to assure clearance for the swinging motion of the seat member into its conditioned nestled within the base, particularly if the tension elements are held by projections 28.

The present invention has been described with reference to preferred embodiments thereof. The scope of the present invention, however, is intended not to be limited by the specifics described in connection with the preferred embodiments, but by the following claims.

What is claimed:

1. A foldable chair comprising:

a base having spared apart upstanding portions extending upwardly from opposite sides of a forward portion thereof, and runner portions extending rearwardly from lower end of respective upstanding portions, a seat member having a rear portion and a forward end portion, said forward end portion being connected pivotally between said upstanding portions of said base, said upstanding portions of said base extending upwardly of said pivotal connection of said seat member by a substantial distance and having free upper ends, a backrest portion extending upwardly from said rear end of said seat portion, a respective flexible, non-extendisble, tension element connected between an upper free end of each upstanding portion and respective rear portions of said seat member for holding said seat member in an operative seating positon relative to said base, said flexible tension elements being fixedly connected to said respective rear portions of said seat member, and being removably connected to said respective upper free ends of each upstanding portion of said base, said flexible tension elements being removably connected to said free upper ends at a position spaced a substantial distance above said pivotal connection, and releasable retaining means for releasably connecting said flexible tension elements to said free upper ends, said releasably retaining means including at least one nub formed on an end portion of each respective flexible tension element, and a respective slot formed in the associated free upper ends, said slot having a portion having a width wider than the width of each said nub and narrowing to a portion narrower than the width of each of said nub whereby a nub can be inserted in said slots and held behind said narrow portions thereof, said flexible tension elements being releasable from said free upper ends and thereby enabling said seat member to be pivoted forwardly about said pivotal connection into a position wherein said backrest portion is nested within said runner portions of said base and said seat portion is nested within said upstanding portions of said base to provide a compact, stackable nested structure.

2. A foldable chair according to claim 1, including aplurality of said nubs formed on the end portons of each said tension element whereby the length of said tension elements extending between said upper ends and the associated rear portions can be varied to adjust the operative position of said seat member to said support member.

3. A foldable chair according to claim 1, the upper ends of said support member being hollow, and means including portions removably inserted into the hollow of said upper ends and having arm portions extending rearwardly therefrom for providing a removable armrest.

4. A foldable chair according to claim 1, further comprising arm portions extending rearwadly from the respective free upper ends of said upstanding portions of said base.

5. A foldable chair according to claim 1 wherein said base comprises a cross-piece portion extending between rearward portions of said runner portions.

* * * * *